US005788204A

United States Patent [19]

Goodwin et al.

[11] Patent Number: 5,788,204

[45] Date of Patent: Aug. 4, 1998

[54] PUMP JACK BASE

[76] Inventors: Jeffrey G Goodwin, R.D. 2, Box 35; Howard W Hughes, R.D. 7, Box 327, both of Wellsboro, Pa. 16901

[21] Appl. No.: 721,358

[22] Filed: Sep. 26, 1996

[51] Int. Cl.[6] ..... F16M 13/02

[52] U.S. Cl. ..... 248/357; 182/111; 248/237

[58] Field of Search ..... 248/237, 357, 248/351, 291.1; 182/111

[56] References Cited

U.S. PATENT DOCUMENTS

| | | | |
|---|---|---|---|
| 1,852,751 | 4/1932 | Johnson | 182/109 |
| 2,309,484 | 1/1943 | Van Meter | 182/109 |
| 3,333,802 | 8/1967 | Goodman | 248/237 X |
| 4,415,062 | 11/1983 | Shaw | 182/111 X |
| 4,423,797 | 1/1984 | Batten | 182/111 X |
| 4,683,983 | 8/1987 | Murphy | 182/111 X |
| 4,826,122 | 5/1989 | Cupp | 248/237 |
| 4,852,692 | 8/1989 | Flaherty | 248/237 X |
| 5,064,024 | 11/1991 | Barham | 182/111 X |

*Primary Examiner*—Peter M. Cuomo
*Assistant Examiner*—Stephen Vu
*Attorney, Agent, or Firm*—Michael I. Kroll

[57] ABSTRACT

A pump jack base (10) for a pole (12) of a pump jack scaffold (14) comprising a base plate (16). A facility (18) is for securing the base plate (16) to a generally flat support surface (20). A structure (22) is for holding a lower end of the pole (12) of the pump jack scaffold (14). An assembly (24) is for attaching the holding structure (22) to the base plate (16) in an adjustable manner. The pole (12) can be positioned within one hundred and eighty degree angle with respect to the base plate (16) to compensate for the pitch and slope of the generally flat support surface (20).

13 Claims, 2 Drawing Sheets

PUMP JACK BASE

BACKGROUND OF THE INVENTION

1. Field of the Invention

The instant invention relates generally to support devices and more specifically it relates to a pump jack base.

2. Description of the Prior Art

Numerous support devices have been provided in prior art. For example, U.S. Pat. No. 5,240,342 to Kresa, Jr.; U.S. Pat. No. 5,307,899 to Lubinski; U.S. Pat. No. 5,413,312 to Bobel and U.S. Pat. No. 5,435,107 to Seibold all are illustrative of such prior art. While these units may be suitable for the particular purpose to which they address, they would not be as suitable for the purposes of the present invention as heretofore described.

KRESA, JR., WALTER

Variable Angle Joist Support

U.S. Pat. No. 5,240,342

A variable angle joist support includes a base plate mounted to a first surface of a supporting beam and a pair of spaced apart support sides flexibly attached to the base plate. The support sides sandwich a joist to be supported at a variable interface angle relative to the beam. Each support side includes a support section which is positionable to fit flush against respective side surface of the joist. The flexible attachment of the support sides to the base plate allows the support sides to pivot about a beam mounted base plate in order to receive a joist at any desired interface angle. The support sides can be flexibly attached to the base plate using hinges or malleable accordion shaped sections. The support sides can be provided with coplanar bottom flanges for support of and interconnection to a bottom surface of the joist. The support sides may be made of a malleable material or include multiple hinged support sections.

LUBINSKI, RONALD

Pump Jack Scaffold

U.S. Pat. No. 5,307,899

A pump jack scaffold includes a pair of extruded aluminum poles. Each pole has a rectangular cross-section. Wood is adhered to one side wall of each pole, providing a surface a jack mechanism can grip. Each of the other three side walls is extruded with a longitudinal structure, internal to the pole, which defines a lengthwise T-slot opening into the exterior of the associated sidewall. Bolts are inserted into the T-slots to fasten braces, which can be used either to engage an adjacent building structure, to join the uprights to define a more unitary structure, or to render the scaffold self-supporting. Each pole is separable into upper and lower sections for transportation. The sections are joined by a resilient internal bridging member which is extruded of aluminum. It has an elongate central portion, webs extending radially from the central part, and a bracing portion terminating each web and engaging a corner of the pole. Upper and lower locking pins extend through aligned openings formed in the pole sections and the bridging member to secure the sections. The bracing portions are spaced to define longitudinal slots that closely receive the internal longitudinal structures extruded with the pole, reinforcing the pole against twisting.

BOBEL, DENNIS B.

Jack Device for Positioning Planks or Other Articles on Framework

U.S. Pat. No. 5,413,312

The present invention is directed to a device for positioning planks or other articles which are to be set on a framework. The invention includes a platform having feet to stabilize the platform with respect to the framework. A connecting rod, a guide brace and a platen are all pivotally attached to the platform. The connecting rod has a proximal and distal end. The distal end of the connecting rod is attached to an end of the guide brace as well as the platen. The opposite end of the guide brace is pivotally attached to the platform. The proximal end of the connecting rod is pivotally attached to a handle assembly which in turn is pivotally connected to the platform. A rotational torque applied to the handle is transmitted by the handle assembly to the connecting rod which in turn causes the platen to apply a force to the plank or other article to be bent. An optional anti-reverse mechanism is pivotally attached to the platform and is biased into engagement with the connecting rod, so that the connecting rod can be held in place and the handle assembly released when the plank or other article is to be set.

SEIBOLD, GUNTER

Bracket for Repairing an Attachment of an Outer Facade Element to an Inner Load-Bearing Member U.S. Pat. No. 5,435,107

The bracket for repairing an attachment of an outer facade element to a load-bearing concrete member includes a flange attachable to the load-bearing concrete member. A supporting arm is attached to the flange and is provided with a longitudinal slot. A jack mountable in the longitudinal slot in the supporting arm is for support of the outer facade element. The jack is adjustably positionable in the longitudinal slot of the supporting arm to compensate for different spacings of the outer facade element from the load-bearing concrete member. The jack includes a threaded bolt having a head. A bearing plate is attached to the head for bearing on the outer facade element. A support plate is secured to the bolt and is bearing on the supporting arm. The bearing plate is arched transversely to the longitudinal direction of the supporting arm, so as to be engageable with a curved surface of a hole drilled in the outer facade element.

SUMMARY OF THE INVENTION

A primary object of the present invention is to provide a pump jack base that will overcome the shortcomings of the prior art devices.

Another object is to provide a pump jack base that is a one man installation taking approximately two minutes to secure to any surface, such as a roof, wall or ground, and will not allow a pole of a pump jack scaffold to move in any direction, thereby holding it secure.

An additional object is to provide a pump jack base in which its angle hinge allows use on any pitch or slope roof and vertical use on walls, while it can be staked for pinned to variable ground conditions.

A further object is to provide a pump jack base that is simple and easy to use.

A still further object is to provide a pump jack base that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
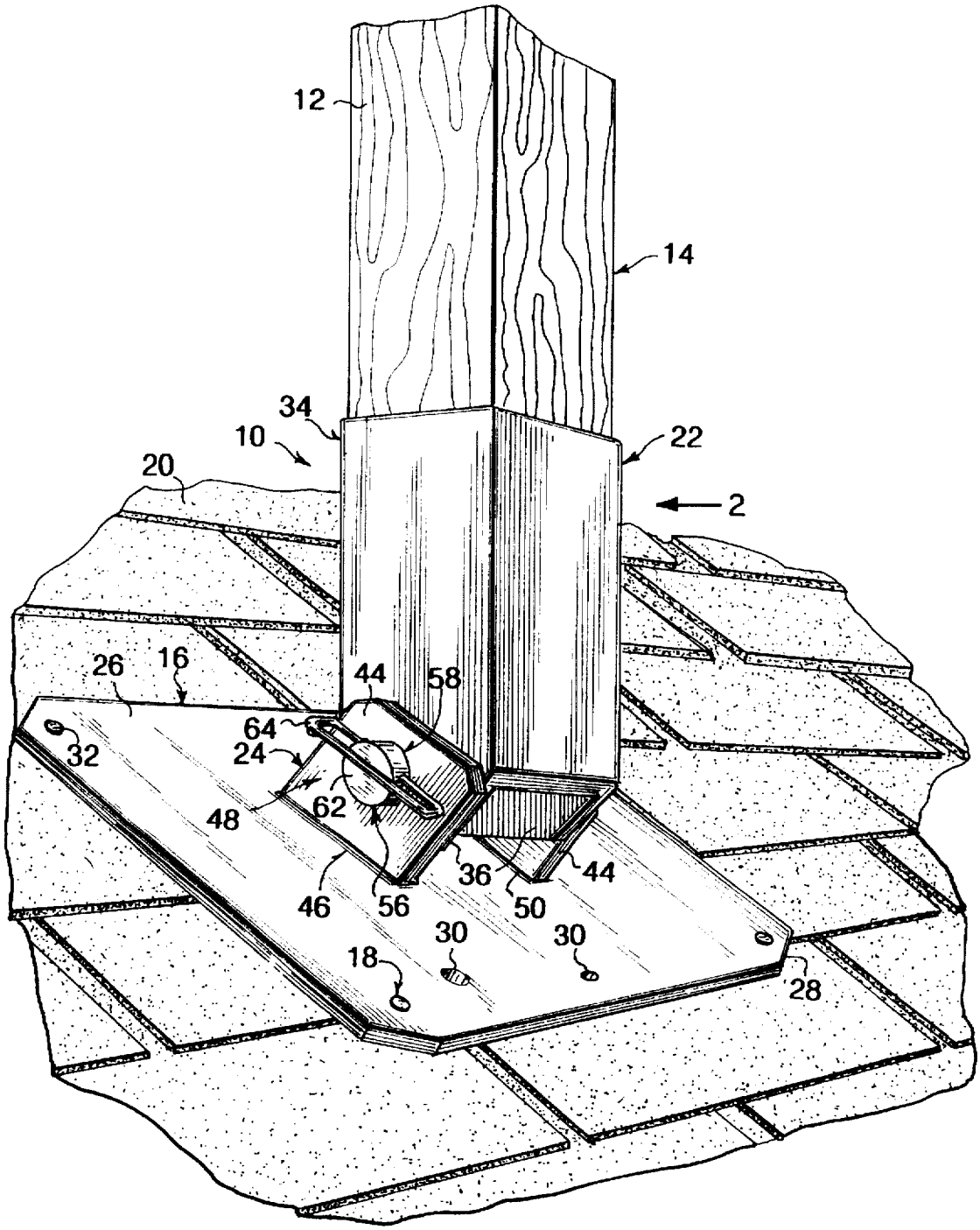
FIG. 1 is a perspective view of the instant invention installed on a roof of a building.
Figure 2:
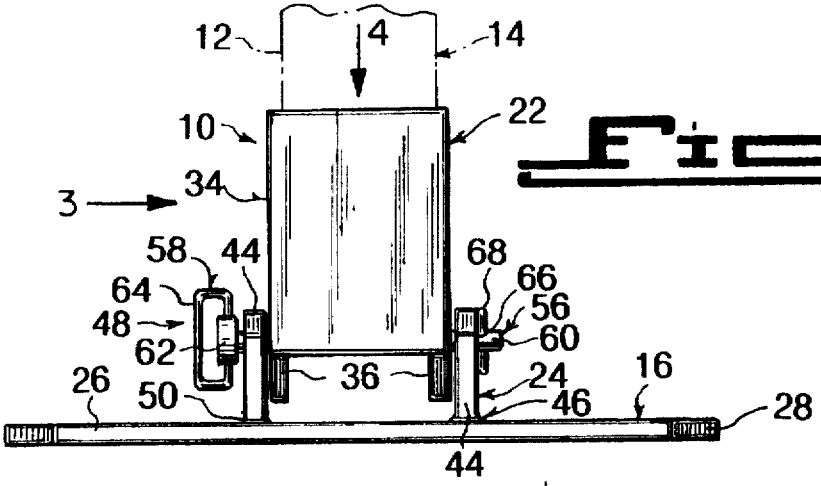
FIG. 2 is a front elevational view taken in the direction of arrow 2 in FIG. 1.
Figure 3:
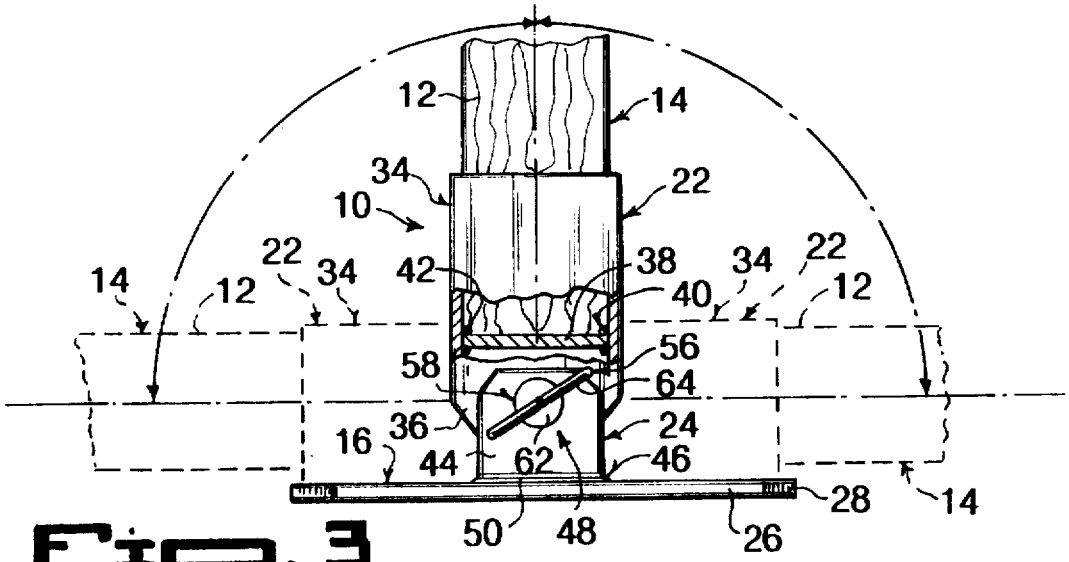
FIG. 3 is a side elevational view taken in the direction of arrow 3 in FIG. 2, with parts broken away and in section.
Figure 4:
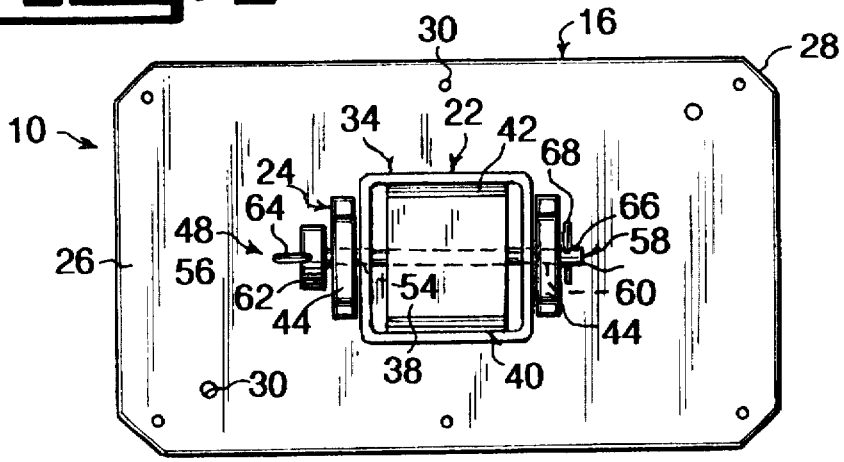
FIG. 4 is a top plan view taken in the direction of arrow 4 in FIG. 2.

Turning now descriptively to the drawings, in which similar reference characters denote similar elements throughout the several views, FIGS. 1 through 4 illustrate a pump jack base 10 for a pole 12 of a pump jack scaffold 14 comprising a base plate 16. A facility 18 is for securing the base plate 16 to a generally flat support surface 20, which can be a roof, wall or ground. A structure 22 is for holding a lower end of the pole 12 of the pump jack scaffold 14. An assembly 24 is for attaching the holding structure 22 to the base plate 16 in an adjustable manner. The pole 12 can be positioned within one hundred and eighty degree angle with respect to the base plate 16, to compensate for the pitch and slope of the generally flat support surface 20.

The base plate 16 is a flat thin rectangular member 26 having beveled corners 28. The securing facility 18 includes the base plate 16 having a plurality of apertures 30 therethrough. A plurality of pointed fasteners 32, such as nails or spikes, are driven through the apertures 30 and into the generally flat support surface 20, as shown in FIG. 1.

The holding structure 22 is a cup 34 having tapered lower ends 36. The cup 34 receives the lower end of the pole 12 of the pump jack scaffold 14 therein. The cup 34 consists of a stop plate 38 slightly narrower along two opposite long edges than inner area of the cup 34. An element 40 is for retaining the stop plate 38 within the cup 34, so as to prevent the lower end of the pole 12 from dropping all the way down into the cup 34. The retaining element 40 is a weld 42 applied between two opposite short edges of the stop plate 38 and two inner abutting surfaces of the cup 34, so that two spaces are provided therebetween for moisture dispersion.

The attaching assembly 24 includes a pair of stanchion ears 44. A facility 46 is for affixing the stanchion ears 44 centrally spaced apart and perpendicular onto the base plate 16. An assemblage 48 is provided for pivoting the tapered lower ends 36 of the cup 34 between the stanchion ears 44, so that the cup 34 can pivot through the one hundred and eighty degree angle with respect to the base plate 16. The affixing facility 46 is a weld 50 applied between a bottom edge of each stanchion ear 44 and a top surface of the base plate 16.

The pivoting assemblage 48 consists of each stanchion ear 44 having a hole 52 therethrough. Each tapered lower end 36 of the cup 34 has an opening 54 therethrough, whereby the holes 52 are in alignment with the openings 54. A pin assembly 56 extends through the holes 52 in the stanchion ears 44 and the openings 54 in the tapered lower ends 36 of the cup 34.

The pin assembly 56 includes a pin 58 having an elongated shank 60, an enlarged head 62 with finger grip 64 on a first end of the shank 60 and a transverse hole 66 near a second end of the shank 60. A pin clip 68 is inserted through the transverse hole 66 in the elongated shank 60, to keep the pin 58 in place.

OPERATION OF THE INVENTION

To use the pump jack base 10, the following steps should be taken:

1. Place the tapered lower ends 36 of the cup 34 between the stanchion ears 44 on the base plate 16.
2. Insert the elongated shank 60 of the pin 58 through the holes 52 in the stanchion ears 44 and the openings 54 in the tapered lower ends 36 of the cup 34.
3. Put the pin clip 68 through the transverse hole 66 in the elongated shank 60 of the pin 58.
4. Insert the lower end of the pole 12 of the pump jack scaffold 14 into the cup 34 and against the stop plate 38.
5. Position the base plate 16 on the generally flat support surface 20.
6. Drive the pointed fasteners 32 through the apertures 30 in the base plate 16 and into the generally flat support surface 20.
7. Pivot the pole 12 in the cup 34 to a vertical position, so that the pump jack scaffold 14 can be properly utilized.

LIST OF REFERENCE NUMBERS

10 pump jack base
12 pole of 14
14 pump jack scaffold
16 base plate of 10
18 securing facility of 10
20 generally flat support surface
22 holding structure of 10
24 attaching assembly of 10
26 flat thin rectangular member for 16
28 beveled corner of 26
30 aperture in 16
32 pointed fastener for 18
34 cup for 22
36 tapered lower end of 34
38 stop plate of 34
40 retaining element of 38
42 weld for 40
44 stanchion ear of 24
46 affixing facility of 44
48 pivoting assemblage of 24
50 weld for 46
52 hole in 44
54 opening in 36
56 pin assembly of 48
58 pin of 56
60 elongated shank of 58
62 enlarged head of 58

64 finger grip on 62

66 transverse hole in 60

68 pin clip of 56

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A pump jack base for connection to a pole of a pump jack scaffold, said pump jack base comprising:

a) a base plate;

b) means for securing said base plate to a generally flat support surface;

c) means for holding a lower end of the pole of the pump jack scaffold; and d) means for attaching said holding means to said base plate in an adjustable manner, so that the pole can be positioned within one hundred and eighty degree angle with respect to said base plate to compensate for the pitch and slope of the generally flat support surface, wherein said holding means is a cup having tapered lower ends, said cup is adapted to receive the lower end of the pole of the pump jack scaffold therein, said cup including:

i) a stop plate slightly narrower along two opposite long edges than inner area of said cup; and ii) means for retaining said stop plate within said cup, so as to prevent the lower end of the pole from dropping all the way down into said cup, said means for retaining being a weld applied between two opposite short edges of said stop plate and two inner abutting surfaces of said cup, so that two spaces are provided therebetween for moisture dispersion.

2. A pump jack base as recited in claim 1, wherein said base plate is a flat thin rectangular member having beveled corners.

3. A pump jack base as recited in claim 1, wherein said securing means includes:

a) said base plate having a plurality of apertures therethrough; and b) a plurality of pointed fasteners which are driven through said apertures and into the generally flat support surface.

4. A pump jack base as recited in claim 1, wherein said attaching means includes:

a) a pair of stanchion ears;

b) means for affixing said stanchion ears centrally spaced apart and perpendicular onto said base plate; and c) means for pivoting said tapered lower ends of said cup between said stanchion ears, so that said cup can pivot through the one hundred and eighty degree angle with respect to said base plate.

5. A pump jack base as recited in claim 4, wherein said affixing means is a weld applied between a bottom edge of each said stanchion ear and a top surface of said base plate.

6. A pump jack base as recited in claim 4, wherein said pivoting means includes:

a) each said stanchion ear having a hole therethrough;

b) each said tapered lower end of said cup having an opening therethrough, whereby said holes are in alignment with said openings; and c) a pin assembly which extends through said holes in said stanchion ears and said openings in said tapered lower ends of said cup.

7. A pump jack base as recited in claim 6, wherein said pin assembly includes:

a) a pin having an elongated shank, an enlarged head with finger grip on a first end of said shank and a transverse hole near a second end of said shank; and b) a pin clip which is inserted through said transverse hole in said elongated shank to keep said pin in place.

8. A pump jack base for connection to a pole of a pump jack scaffold, said pump jack base comprising:

a) a base plate being a flat thin rectangular member having beveled corners;

b) means for securing said base plate to a generally flat support surface;

c) means for holding a lower end of the pole of the pump jack scaffold; and d) means for attaching said holding means to said base plate in an adjustable manner, so that the pole can be positioned within one hundred and eighty degree angle with respect to said base plate to compensate for the pitch and slope of the generally flat support surface, wherein said holding means is a cup having tapered lower ends, said cup is adapted to receive the lower end of the pole of the pump jack scaffold therein, said cup including:

i) a stop plate slightly narrower along two opposite long edges than inner area of said cup; and ii) means for retaining said stop plate within said cup, so as to prevent the lower end of the pole from dropping all the way down into said cup, said means for retaining being a weld applied between two opposite short edges of said stop plate and two inner abutting surfaces of said cup, so that two spaces are provided therebetween for moisture dispersion.

9. A pump jack base as recited in claim 8, wherein said securing means includes:

a) said base plate having a plurality of apertures therethrough; and b) a plurality of pointed fasteners which are driven through said apertures and into the generally flat support surface.

10. A pump jack base as recited in claim 9, wherein said attaching means includes:

a) a pair of stanchion ears;

b) means for affixing said stanchion ears centrally spaced apart and perpendicular onto said base plate; and c) means for pivoting said tapered lower ends of said cup between said stanchion ears, so that said cup can pivot through the one hundred and eighty degree angle with respect to said base plate.

11. A pump jack base as recited in claim 10, wherein said affixing means is a weld applied between a bottom edge of each said stanchion ear and a top surface of said base plate.

12. A pump jack base as recited in claim 11, wherein said pivoting means includes:

a) each said stanchion ear having a hole therethrough;

b) each said tapered lower end of said cup having an opening therethrough, whereby said holes are in alignment with said openings; and c) a pin assembly which extends through said holes in said stanchion ears and said openings in said tapered lower ends of said cup.

13. A pump jack base as recited in claim 12, wherein said pin assembly includes:

a) a pin having an elongated shank, an enlarged head with finger grip on a first end of said shank and a transverse hole near a second end of said shank; and b) a pin clip which is inserted through said transverse hole in said elongated shank to keep said pin in place.

* * * * *